United States Patent [19]

Kriebitz et al.

[11] 3,936,544

[45] Feb. 3, 1976

[54] PROCESS FOR THE MANUFACTURE OF FLAT-SHAPED ARTICLES

[75] Inventors: Helmut Kriebitz, Viersen; Theodor Ploetz, Hoesl; Popko Julius Westerhuis, Hueckelhoven-Baal, all of Germany

[73] Assignee: Feldmuehle Aktiengesellschaft, Dusseldorf-Oberkassel, Germany

[22] Filed: May 10, 1974

[21] Appl. No.: 469,041

[30] Foreign Application Priority Data

May 10, 1973 Germany ..... 2323583

[52] U.S. Cl. ..... 427/335; 427/341; 427/342

[51] Int. Cl.[2] ..... B05D 3/04; B05D 3/10

[58] Field of Search .... 117/62, 63, 138.8 N, 140 A, 117/143 A, 155 UA, 119.8; 427/335, 341, 342, 348

[56] References Cited

UNITED STATES PATENTS

| | | | |
|---|---|---|---|
| 3,437,509 | 4/1969 | Coisne | 117/62 |
| 3,476,581 | 11/1969 | Weitzel et al. | 117/62 |
| 3,776,799 | 12/1973 | Gruber et al. | 156/305 |

*Primary Examiner*—Michael R. Lusignan
*Attorney, Agent, or Firm*—John A. Caruso

[57] ABSTRACT

A process is disclosed for manufacturing flat shaped articles made of individual fibers such as paper, woven fabric, knitted fabric and non-woven fabric impregnated with an aqueous dispersion of a polymeric binder including a sensitizing agent for causing the dispersion to coagulate at a temperature substantially below 100°C. The binder coagulates at a temperature substantially below 100°C. and the method includes impinging live steam on the major surfaces of the article to suddenly coagulate the binder, thereby fixing its position within the fabric and preventing its migration to the fabric's surfaces. One or more adjustable position steam nozzles are used for this purpose.

12 Claims, 2 Drawing Figures

PROCESS FOR THE MANUFACTURE OF FLAT-SHAPED ARTICLES

BACKGROUND OF THE INVENTION

This invention relates to the manufacture of fibrous, flat-shaped articles and, more particularly, to a process for coagulating aqueous heat-coagulatable polymer binder dispersions impregnated in or coated on such articles.

The term "flat-shaped articles", as used in this application, includes material formed from individual fibers such as, for example, paper, woven fabric, knitted fabric and non-woven fabric. Of these, since non-woven fabrics are the most interesting, with their broad field of use, the invention will be described using the term non-woven fabric. Nonetheless, it should be clear that the inventive process is also applicable to the above-mentioned broader class of fibrous flat-shaped articles.

It is known to make non-woven fabric by forming a non-woven sheet, impregnating the sheet with an aqueous dispersion of a heat-coagulatable polymer binder and to coagulate the dispersion by heating (see U.S. Pat. No. 3,776,799). Known techniques for accomplishing such heating include the use of hot air, heated drums and infrared radiation. However, when a non-woven sheet is heated on both sides by any one of these techniques, water evaporates from both surfaces and the binder migrates toward the evaporation surfaces leaving a space in the middle of the sheet which contains only a very small proportion of binder. Such uneven distribution of the binder in the sheet tends to weaken it and causes it to split or delaminate along the core (i.e., in the area of low binder concentration) when subjected to severe stress. Binder migration upon drying, therefore, presents the man skilled in the art with serious problems.

In order to eliminate these problems, binder dispersions which reduce or eliminate binder migration on exposure to heat have been developed. One known technique to reduce binder migration is to add a thickening agent to the dispersion. Thickening agents, however, are difficult to remove from the sheet after the sheet has been dried and if they remain in the sheet they tend to impair the hand of the finished fabric.

A better known solution to the problem of binder migration is the use of heat sensitizing agents in the dispersion which causes the binder to begin coagulating at such low temperatures that pratically no evaporation takes place before coagulation begins. Depending on the heat sensitizing agents used and the binder system with which they are used, coagulation takes place either by the dispersed binder particles agglomerating to form larger particles which adhere to the fibers in the sheet, or the dispersion, with the binder in it, solidifies into a gel. In either case, by choosing one of these systems and appropriate choice of and proportions of chemical agents, the dispersion can be adjusted to be stable up to a desired temperature below 100°C. and to coagulate suddenly, for example, at between about 30°C. and 80°C. When a non-woven sheet is impregnated with such heat sensitized dispersions and the sheet is subjected to heat, the effect of the heat is to cause sudden coagulation of the binder in the dispersion either by flocculation onto the fibers or by the formation of the dispersion into a gel. In both cases, the location of the binder throughout the fabric in the heating zone is fixed at a temperature below the evaporation temperature of the water so no migration can occur even during subsequent drying of the sheet.

Though these techniques work well in theory, in actual practice, various difficulties have been encountered. Thus, heretofore, for example, after a non-woven sheet has been impregnated either by spraying or dipping, etc., it has in some instances been heated by direct contact with steam heated drums or rolls such as can dryers. While such dryers heat the material sufficiently for coagulation to occur, the binder tends to migrate in a direction away from the drum and the material tends to stick to the dryers, causing surface defects in the sheet.

Infrared heating, while avoiding the surface defect problem of steam heated drums, has several other problems associated with it. The energy density of infrared radiators is low so the area which they cover has to be relatively large. Further, when a continuous web of heat-sensitized aqueous binder dispersion impregnated non-woven material is passed horizontally between infrared radiators and the web breaks, it falls on the lower radiator, presenting a fire hazard. Also, continued processing of the web is delayed while the radiators cool sufficiently to remove it and rethread the apparatus.

Further, it is difficult to adjust the heat output of infrared radiators so that coagulation occurs without unwanted drying. If, on the other hand, a coagulation by flocculation heat-sensitized aqueous binder system is used and the impregnated fabric passes vertically between two infrared radiators, the aqueous residue which is liberated on coagulation of the binder dispersion tends to flow downward in the sheet from the point of coagulation making it impossible to control the dilution of the binder in the non-coagulated portion of the sheet resulting in a finished product having non-uniform properties. The flow of this residue to still uncoagulated portions of the material not only dilutes the binder dispersion in those portions, it also means that more heat energy has to be imparted to that area to achieve coagulation. If this heat is not forthcoming, the material will contain binder in uncoagulated form and migration problems will occur during drying of the sheet at a later stage.

Accordingly, it is the principal object of this invention to provide a method which avoids the disadvantages of known prior art techniques and in which binder migration is prevented in a simple, economic manner.

SUMMARY OF THE INVENTION

In a process for manufacturing fibrous flat-shaped articles such as paper, knitted fabric, woven fabric and non-woven fabric which have been coated or impregnated with a dispersion of a polymeric binder including a sensitizing agent for causing the dispersion to coagulate at a temperature substantially below 100°C of the invention comprises the step of impinging live steam on the treated material to suddenly heat the dispersion in the material causing it to coagulate. This steam impinging step includes directing at least one jet of steam at a pressure higher than atmospheric pressure against at least one major surface of the article. Where the material is a non-woven, it is preferably impregnated with a heat-sensitized, aqueous, colloidal dispersion of a polymeric binder having a coagulation temperature of between about 30°C. to about 80°C. The preferred process according to the invention also includes the step of removing at least a portion of the aqueous residue from the material after coagulation by a non-evaporative technique such as squeezing the material following its exposure to live steam. Thereafter, if desired, the material may be washed to remove further portions of this residue. The preferred process according to the invention additionally includes the step of impinging the steam on the material in a narrowly defined zone. Another preferred aspect of the process according to the invention includes the step of impinging superheated steam on the treated material.

In apparatus for manufacturing fibrous flat-shaped articles which are coated or impregnated with a heat-coagulatable aqueous polymeric binder dispersion coagulatable at temperatures below 100°C. and in which apparatus there are means for coating or impregnating such articles, means for moving them through the apparatus and means for drying them after coagulation, one aspect of the invention includes providing means for impinging live steam on the coated or impregnated article for suddenly coagulating the binder in the article. When used for non-woven materials impregnated with a binder dispersion adapted to adhere the fibers when subjected to heat (rather than one which forms a gel on heating), the apparatus preferably also includes nonevaporative means for removing at least a portion of the aqueous residue from the dispersion after the binder has flocculated and its position in the material has become fixed and before the article is dried. In the preferred embodiment of the apparatus, such means include means for squeezing the material to remove a portion of the residue from it. Means may also be included for washing the non-woven to remove additional portions of the residue.

The apparatus for impinging live steam on articles impregnated with heat sensitized binder systems preferably comprises at least one steam fed pipe adjacent one side of the article. The pipe preferably has a plurality of steam nozzles spaced apart in a line along its length with the nozzles aimed toward the article. The pipe is preferably rotatable about its central axis so the direction of its nozzles can be adjusted. Further, preferably the pipe is movable toward and away from the article to adjust the distance between the nozzles and the article. Where the apparatus is designed for use with non-woven materials, there are preferably two such pipes on opposite sides of the material, both of which are rotatable about their own axes and movable toward and away from the material.

The use of steam as a high energy carrier impinging upon one or more sides of an article coated or impregnated with a heat-coagulatable binder dispersion heats the article quickly accomplishing sudden coagulation of the binder without evaporation and overcomes the other disadvantages of can driers or infrared treating equipment as well. By treating such articles with steam it is possible to transport an article comprising a continuous web of material horizontally between the heating units without any danger of fire, even if the material tears. Further, by simply shutting off the steam, the torn material can rapidly be passed through the narrowly defined steaming zone and rethreaded through the equipment. Because of the high energy density of steam it is not only possible to locate the equipment in a very small amount of space, it also makes possible the faster operation of the apparatus, particularly if the steam used is superheated.

When aqueous binder systems are used which flocculate on being exposed to heat, flocculation on exposure to live steam creates a sudden separation of the water in the dispersion from the binder without evaporation of water taking place in the steaming zone. When infrared heating equipment is used, and particularly if the infrared path is not carefully controlled or overdimensioned, evaporation cannot be prevented. Another advantage of the preferred process according to the invention is that when a flocculating heat-sensitized aqueous binder system is used and the material is subjected to live steam, the water which is separated out from the binder contains a large part of the undesired adjuvants including the heat-sensitizing and emulsion stabilizing aids (i.e., chemical agents) which were present in the dispersion both in dissolved and finely dispersed form. Because this liquid residue is created as a result of the steam treatment rather than from evaporation causing heat, it tends to be diluted (by the steam) rather than thickened and bound more firmly to the fibers as would tend to occur with a heating system in which evaporation occurs.

The step of the preferred process according to the invention in which an article is pressed out or squeezed immediately after coagulation is of particular importance, because this pressing or squeezing not only removes a substantial part of the undesired liquid residue with its dissolved and finally dispersed chemicals from the material, it does this immediately following coagulation so that there is little chance for the residue to be bound to the material by evaporative heating which occurs when the material is dried.

An additional important advantage in the process according to the invention is that the residue which has been squeezed from the sheet material need not be evaporated at all. This in turn results in a considerable savings in the amount of energy required to dry the material, because there is less liquid in it to be dried. Though it is often desirable to wash articles or sheet material after squeezing the liquid residue from them, after the washing step they can again be squeezed in order to remove additional chemicals and water to reduce the amount of energy required for the final drying step.

Any suitable water dispersable binders which are heat sensitizable are suitable in the practice of the invention. There are numerous such materials known to those skilled in the art and the details need not be repeated here. Illustrative well known classes of suitable binders for the process according to the invention include elastic, synthetic or natural polymers which can be coagulated from an aqueous dispersion under the influence of heat. Particularly suitable are: aqueous dispersions of copolymers of butadiene, acrylonitrile and minor amounts of methacrylic acid with free carboxyl groups; copolymers of carboxylated-butadiene-acrylonitrile; butadiene-styrene copolymers modified to include carboxylic groups in the polymer chain; and other polyacrylic and polymethacrylic acid esters and natural or synthetic rubber latex. Some of these products are available under the following trade names from the indicated manufacturers:

"Perbunan-N-Latex 4M", "Perbunan-N 3415 M" and "N Latex T", products of Farbenfabriken Bayer;

"Hycar 2570 x 1" and "Hycar 1570 H 6", products of CIAGO (N. V. Chemische Industrie AKU-Goodrich);

"Primal HA 8", "Primal HA 12" and "Primal HA 16", products of Rohm & Haas;

"Acronal 500 D", a product of BASF (Badische Analine Soda Fabrik); and

"LCG 4412 LATEX", a product of Goodyear Chemical Div. (France).

Any suitable emulsion stabilizers known to be subject to the action of heat sensitizing agents are also suitable in the practice of the invention. There are numerous such materials known to those skilled in the art and the details need not be repeated here. Illustrative well known classes of stabilizers include electrically neutral fatty acid condensation products and alkylaryl polyether alcohols of the octylphenol series, for example, water soluble isooctylphenol-polyethoxy-ethanol containing ten moles of ethylene oxide. The former is available from Bayer under the trade name "Emulvin W". The latter is available from Rohm & Haas under the trade name "Triton X-100".

Further, any suitable heat sensitizing agents known to be useful in making such water dispersable binder dispersions sensitive to the presence of heat are suitable for the practice of this invention. There are numerous such materials known to those skilled in the art. One such class of agents includes functional organopolysiloxanes which are useful for adjusting the coagulation temperature of such binders to between about 30°C. and about 80°C. One such agent is available from Bayer under the trade name "Coagulant WS".

In addition, any suitable agents known to be useful in dispersing the vulcanizing agents in these binder systems are suitable in the practice of the invention. There are numerous such agents known to those skilled in the art so they need not be mentioned here. For example, one well known class of such agents comprise Naphthalenesulfonic acid condensation products. Further, one of these products is available from BASF (Badische Analine Soda Fabrik) under the trade name "Vultamol".

Other features and advantages of the process and apparatus according to the invention will be apparent from the following description taken in connection with the drawing and the amended claims.

DETAILED DESCRIPTION OF THE INVENTION

Figure 1:
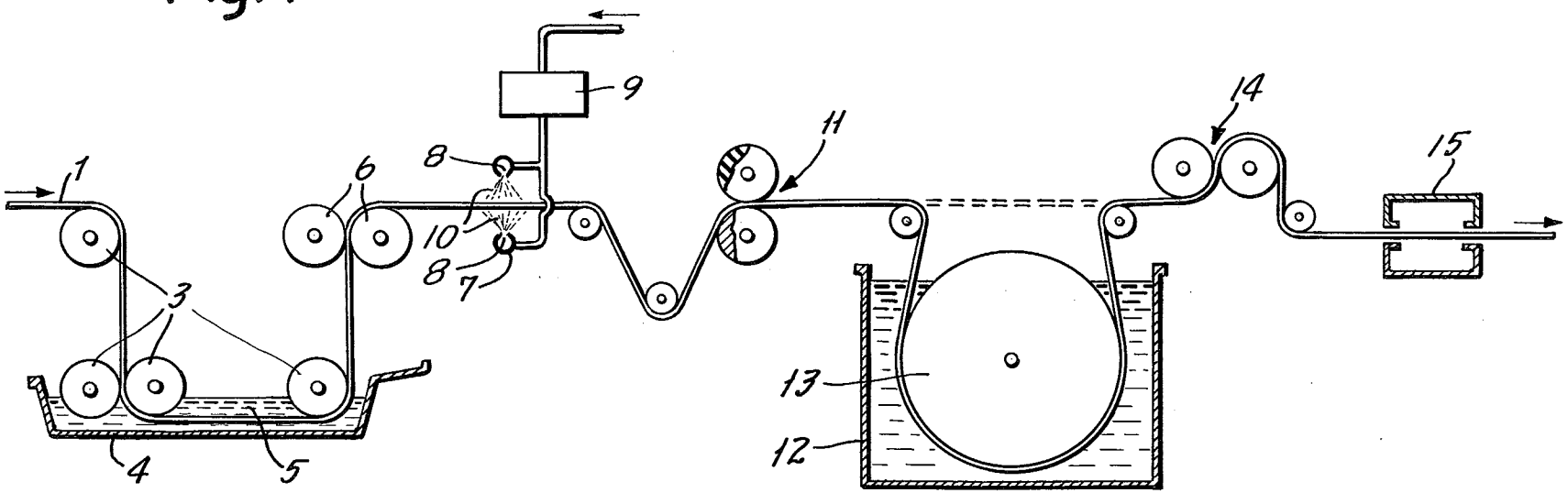
FIG. 1 is a diagramatic view of the preferred apparatus.
Figure 2:
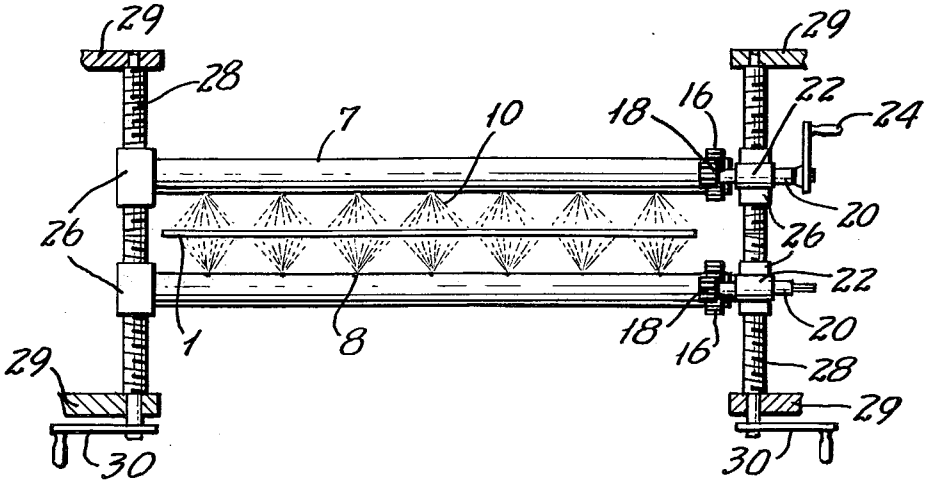
FIG. 2 is a profile view of the steam pipe portions of the apparatus of FIG. 1 shown in profile and illustrating means for adjusting the rotational positions of the pipes as well as for adjusting their distances from the sheet material.

Referring to FIGS. 1 and 2 of the drawings, the preferred embodiment of the apparatus includes means for impregnating and/or coating a continuous non-woven web of material with a heat coagulatable aqueous dispersion of polymer binder material, means for thereafter heating the material to coagulate the binder, means for thereafter washing the material, means for thereafter drying the material and means for moving the web of non-woven material continuously through each of these means, the central feature of the apparatus being characterized by the fact that the coagulating means comprises at least one pair of steam-fed nozzle pipes extending across the direction of travel of the web with its nozzles aimed towards the web. The pipes preferably lie on opposite sides of the web a predetermined adjustable distance away from its major surfaces. Also, there are means for adjusting this distance as well as means for adjusting the rotational position of each pipe about its central axis.

Discussing the process and the preferred embodiment of the apparatus together in somewhat more detail, a web of non-woven fabric 1 is drawn continuously from a supply (not shown) over guide rolls 3 through a tank 4 filled with a heat-sensitized aqueous colloidal dispersion of polymeric binder material 5. The purpose of the tank is to coat or impregnate the article or fabric with the binder dispersion. In the examples set forth below, the fabric web 1 traveled at a linear velocity of from between about 4 to about 20 meters per minute.

Driven squeeze rolls 6 at the discharge end of the tank 4 provide a pulling force on the fabric web 1 for drawing the fabric from the supply. They also reduce the aqueous dispersion content of the web to a desired proportion of the dry fabric weight. The fabric emerges from between these rolls uniformly treated with the binder dispersion. Next, the web passes horizontally between two steam fed nozzle pipes 7, which extend above and below and completely across the path of the traveling web. A row of perforations 8, longitudinally spaced about 1 centimeter apart in each pipe, extends across the width of the fabric. These perforations have a diameter of between about 1–2 millimeters and are directed toward the opposite sides (i.e., the major surfaces) of the fabric web. As illustrated, the pipes are rotatable about their own axes by a linkage system (See FIG. 2).

Since this system is the same for each pipe it will be explained referring to one pipe only. The linkage includes gear wheel 16 mounted concentrically to one end of pipe 7, a pinion gear 18 engaged with the gear wheel 18, a shaft 20 on one end of which the pinion 18 is mounted, a bearing 22 for carrying the shaft 20 and a handle 24 which is removably splined to the end of the shaft opposite the pinion 18. Because the handle 24 is removable it can be mounted on either of the shafts 24. When used to rotate the shaft it adjusts the rotational position of the pipe with which it is associated. Other linkage systems for accomplishing this rotational adjustment may also be used.

Further, any suitable means for adjusting the distances of the two pipes apart from each other may also be used. One such system illustrated in FIG. 2 includes a plurality of threaded collars 26 carrying one end of the pipes 7 and the bearings 22 at the other end of the pipes on a pair of threaded shafts 28 adjacent opposite ends of both pipes. These shafts 28 are mounted vertically in plane of the pipes and lie perpendicularly to them. They are rotatably mounted in supports 29 at their opposite ends and are rotatably drivable by a pair of cranks 30 connected to them. The threads on similar halves of shafts 28 are formed in one direction, but the threads on one half are formed in the opposite direction from those on the other half. Accordingly, when the cranks 30 are rotated in the same direction, the pipes 7 are carried further apart or moved closer together by the collars 26 depending on the direction in which the cranks are rotated.

The pipes 7 are connected to a steam boiler (not shown) through a superheater 9 so that jets of steam 10 are discharged from the pipes against the major faces of fabric web 1. The steam impinges on about 20 linear centimeters of fabric web when the pipes 7 are spaced about 15 centimeters apart and the steam is directed perpendicularly against the fabric web. This gives a heating zone about 20 centimeters long. In the examples set forth hereinafter, the steam in pipes 7 was at a temperature of about 130°C. and at a pressure of about 7.5 p.s.i.g. with a fabric web linear velocity of about 4 meters per minute and about 3 centimeters spacing between pipes 7, the temperature in the web was about 70°C. It has been found from the examples set forth hereinafter, that a period of steaming or contact of steam with the web of up to about 3 seconds is sufficient to cause coagulation of the dispersion.

When performations 8 are aligned in a common vertical plane, as shown in the drawing, directing the steam perpendicularly against the fabric web 1, the length of the heating zone is minimized. Rotation of pipes 7 effects fine adjustment of the distance travelled by the steam, and therefore its temperature, before it impinges on the fabric web and also permits fine adjustment of the length of the heating zone. Additional adjustment of these variables is effected by adjusting the vertical spacing between pipes 7. Preferably this distance is adjustable to leave a distance of from about 1 centimeter to about 15 centimeters between them.

Another pair of driven squeeze rolls 11 pulls the fabric web 1 through the heating zone and squeezes out much of the aqueous residue formed during coagulation. In the preferred embodiment, the squeeze rolls 11 comprise one rubber roll (Shore A hardness 70) and one steel roll.

The fabric web 1 next passes through a wash tank 12 containing a conventional suction cylinder 13 (preferably having a diameter of about 50 centimeters). The dashed line above tank 12 indicates that this washing apparatus may be bypassed if desired.

A third pair of driven squeeze rolls 14 pulls the fabric web 1 through the wash tank 12 and squeezes out more of the residue and much of the wash water picked up in the tank 12. The fabric web 1 next is dried in an oven 15 in a manner conventional in itself and, therefore, not shown or described in detail.

The following examples are further illustrative of the process according to this invention. All percentage values are by weight unless otherwise stated.

EXAMPLE 1

A heat coagulatable aqueous colloidal dispersion of polymeric elastomeric binder was prepared from the ingredients and in the ratio of amounts set forth in the following table:

| Ingredient | Solids weight | Solids % | Total weight |
|---|---|---|---|
| An aqueous dispersion of a vulcanizable copolymer of butadiene, acrylonitile and 4 % methacrylic acid (Perbunan-N-Latex 4M) | 100 kg | 45 % | 222 kg |
| An electrically neutral fatty acid condensation product (Emulvin W) | 6 kg | 20 % | 30 kg |
| A functional organopolysiloxane coagulant (Coagulant WS) | 4,5 kg | 33 % | 13,6 kg |
| Colloidal sulfur | 1,2 kg | | |
| Zinc oxide | 6,0 kg | | |
| 2-mercaptobenzothiazole zinc salt | 0,6 kg | 30 % | 29,7 kg |
| Zinc diethyldithiocarbamate | 0,4 kg | | |
| A naphthalenesulfonic acid condensation product (Vultamol) | 0,8 kg | | |
| Water | — | — | 103,4 kg |
| | 119,5 kg | | 398,7 kg |
| Total solids % about | | 30 % | |

The above aqueous binder dispersion had a coagulation temperature in the range of about 30°–40° C.

A non-woven fabric web consisting of about 30 % nylon fibers and about 70 % cellulose fibers and having a weight of 95 to 100 grams per square meter was impregnated with the above-described aqueous binder dispersion in the apparatus illustrated in the drawing. The binder content, solids basis, of the impregnated fabric was adjusted by squeeze rolls 6 to 100 % based on the dry fiber weight. The linear speed of the fabric was maintained through the apparatus to between about 4 to about 20 meters per minute by squeeze rolls 6.

The fabric web was then exposed to jets of live steam 10 in the heating zone. The steam temperature in pipes 7 was about 130° C; the pressure was about 7.5 p.s.i.g. The vertical spacing between pipes 7 was about 3 centimeters. At a fabric web 1 linear velocity of about 14 meters per minute, the heating zone was about 5 centimeters long. Coagulation of the binder dispersion was instantaneous. When the web was exposed to the jets of steam in this narrower heating zone, the period of steaming necessary to effect coagulation was much shorter than 3 seconds. Respectively for 4, 14 and 20 meters/minute linear speed of the fabric, the period of steaming can be calculated to be, respectively 0.75, 0.21 and 0.15 seconds.

Next, the aqueous residue of the binder dispersion was partly squeezed out by rolls 11. The fabric web was then water washed by passing it over suction cylinder 13 in tank 12. It was then squeezed again between rolls 14 and dried in the oven 15 which raised the temperature in the material to about 150° C. allowing vulcanization to occur.

The ultimate product had a bulk density of 0.465 grams per cubic centimeter. It did not delaminate under stress in any direction sufficient to cause the fabric to break.

EXAMPLE 2

A heat coagulatable aqueous colloidal dispersion of polymeric elastomeric binder was prepared from the ingredients and in the ratio of amounts set forth in the following table:

| Ingredient | Solids weight | Solids % | Total weight |
|---|---|---|---|
| A carboxylic rubber latex comprising a cross linkable butadiene-styrene copolymer modified to include carboxylic groups in the polymer chain and curable at room temperature in the presence of zinc oxide (Hycar 2570 × 1) | 277,5 kg | 55,7 % | 500 kg |
| An electrically neutral fatty acid condensation product (Emulvin W) | 4,- kg | | |
| A functional organopolysiloxane coagulant (Coagulant WS) | 4,- kg | 16,6 % | 60 kg |
| Ammonium chloride | 2,- kg | | |
| Water | — | — | 120 kg |
| Total solids % about | 287,5 kg | 42,4 % | 680 kg |

The above aqueous binder dispersion had a coagulation temperature in the range of about 30°–40° C.

A non-woven fabric web consisting of about 25 % cotton linters, 25 % cellulose fibers and 50 % nylon fibers and having a weight of 200 grams per square meter was impregnated with the above-described aqueous binder dispersion and steam coagulated in the apparatus illustrated in the drawing in the manner described in Example 1.

After being steamed the fabric web 1 was passed through squeeze rolls 11 to remove most of the aqueous residue and steam condensate. Wash tank 12 was bypassed, and the fabric was dried in oven 15 maintained at 150°C. The ultimate product, after drying and vulcanization, did not exhibit objectional harshness due to residual sensitizing agent. It had a bulk density of 0.395 grams per cubic centimeter. The fabric did not delaminate when subjected to destructive stresses.

What is claimed is:

1. A method of producing binder-treated flat-shaped fibrous articles, such as paper, woven fabric, knitted fabric and non-woven fabric, by a process which includes a step of uniformly treating the articles with a desired amount of an aqueous dispersion of a polymeric binder including a sensitizing agent for causing said dispersion to coagulate at a temperature substantially below 100°C., heating the articles to coagulate the binder and thereafter drying the articles, the heating step being characterized by directing at least one jet of steam at a pressure higher than atmospheric pressure, said pressure being at least about 7.5 p.s.i.g., against at least one major surface of each of the articles to suddenly coagulate the binder without evaporation of the aqueous vehicle in the dispersion.

2. A method according to claim 1 characterized by immediately squeezing the fibrous articles after binder coagulation to remove from the articles at least a portion of the aqueous residue separated from the dispersion during coagulation of the binder.

3. In a process for bonding fibers in a non-woven fabric together in which the fabric is uniformly impregnated with an aqueous dispersion of a polymeric binder including a sensitizing agent for causing said dispersion to coagulate at a temperature substantially below about 100°C. and in which the fabric is heated to coagulate the binder and thereafter dried, the improvement comprising directing at least one jet of steam at a pressure higher than atmospheric pressure, said pressure being at least about 7.5 p.s.i.g., against at least one major surface of the fabric to suddenly coagulate the binder without evaporation of the aqueous vehicle in the dispersion.

4. In a process according to claim 3, the improvement comprising impinging live superheated steam on the fabric.

5. In a process according to claim 3, the improvement comprising removing from the fabric at least a portion of the aqueous residue separated from the dispersion during coagulation of the binder by a non-evaporative technique.

6. In a method according to claim 5 the improvement wherein the non-evaporative technique comprises squeezing the fabric.

7. In a continuous process for bonding fibers in a continuous non-woven fabric together in which the fabric is uniformly impregnated with an aqueous colloidal dispersion of a polymeric binder including a sensitizing agent for causing said dispersion to coagulate at a temperature substantially below 100°C. and in which the fabric is heated to coagulate the binder and thereafter dried, the improvement comprising directing at least one jet of steam at a pressure higher than atmospheric pressure, said pressure being at least about 7.5 p.s.i.g., against the fabric in a narrowly defined zone on both major surfaces of the fabric to suddenly coagulate the binder without evaporation of the aqueous vehicle in the dispersion.

8. In a process according to claim 7 the improvement comprising moving the fabric past a heating station and at that station impinging the steam on the fabric in a zone having a length across the width of the fabric but not more than a length of about 20 centimeters in the direction in which the fabric is moved past the station.

9. In a process according to claim 7 the improvement comprising squeezing the fabric to remove from the fabric at least a portion of the aqueous residue separated from the dispersion during coagulation of the binder, thereafter washing the fabric in water to remove additional residue followed by squeezing the fabric after the washing step and before drying the fabric.

10. A method according to claim 1 characterized by directing at least one jet of steam against the articles for a steaming period of up to about 3 seconds.

11. In a process according to claim 3, the improvement comprising directing at least one jet of steam against the fabric for a steaming period of up to about 3 seconds.

12. In a process according to claim 7, the improvement comprising directing at least one jet of steam against the fabric for a steaming period of up to about 3 seconds.

* * * * *

UNITED STATES PATENT OFFICE

CERTIFICATE OF CORRECTION

PATENT NO. : 3,936,544

DATED : Feb. 3, 1976

INVENTOR(S) Helmut Kriebitz et al

It is certified that error appears in the above-identified patent and that said Letters Patent are hereby corrected as shown below:

In Column 2, line 57, after "100° C" the words -- , one aspect -- should be inserted.

In Column 8, Example 1 should read, in part, as follows:

| | | | |
|---|---|---|---|
| (Coagulant WS) | | | |
| Colloidal sulfur | 1,2 kg | 30% | 29,7 kg |
| Zinc oxide | 6,0 kg | | |
| 2-mercaptobenzothiazole zinc salt | 0,6 kg | | |
| Zinc diethyldithiocarbamate | 0,4 kg | | |
| A naphthalenesulfonic acid condensation product (Vultamol) | 0,8 kg | | |
| Water | -- | -- | 103,4 kg |
| | 119,5 kg | | 398,7 kg |
| Total solids % about | | 30% | |

In Column 9, Example 2 should read, in part, as follows:

| | | | |
|---|---|---|---|
| An electrically neutral fatty acid condensation product (Emulvin W) | 4,- kg | 16,6% | 60 kg |
| A functional organopolysiloxane coagulant (Coagulant WS) | 4,- kg | | |
| Ammonium chloride | 2,- kg | | |
| Water | -- | -- | 120 kg |
| | 287,5 kg | | 680 kg |
| Total solids % about | | 42,4% | |

Signed and Sealed this

Sixth Day of July 1976

[SEAL]

*Attest:*

RUTH C. MASON
*Attesting Officer*

C. MARSHALL DANN
*Commissioner of Patents and Trademarks*